United States Patent [19]

Wechner

[11] Patent Number: 4,856,384

[45] Date of Patent: Aug. 15, 1989

[54] ROOF BOLT DRILL POT DRIVE

[75] Inventor: Edward Wechner, Minnamura, Australia

[73] Assignee: Joy Technologies Inc., Pittsburgh, Pa.

[21] Appl. No.: 240,879

[22] Filed: Sep. 2, 1988

[30] Foreign Application Priority Data

Sep. 4, 1987 [AU] Australia ..... PI4165

[51] Int. Cl.[4] ..... B25B 21/00

[52] U.S. Cl. ..... 81/57.11; 81/55; 173/57

[58] Field of Search ..... 173/57, 72; 81/54–57, 81/57.11, 57.14, 57.25, 57.4

[56] References Cited

U.S. PATENT DOCUMENTS 2,606,472 8/1952 Curtis et al. ..... 81/57.11
3,141,511 7/1964 O'Leary ..... 81/55 X
3,218,893 11/1965 Madison et al. ..... 81/55
4,294,317 10/1981 Amoroso ..... 173/57
4,298,073 11/1981 Yates ..... 173/57 X

*Primary Examiner*—Frank T. Yost
*Assistant Examiner*—James L. Wolfe
*Attorney, Agent, or Firm*—Kirkpatrick & Lockhart

[57] ABSTRACT

A mining roof bolt drill pot drive wherein the drill chuck and the bolt tightening socket are coaxially mounted and permanently coupled to and simultaneously driven by a drive motor. The drill chuck is directly driven by the drive motor and the bolt socket is driven via a reduction planetary gear box giving speed reduction and torque multiplication. An automatic valve for supplying cooling water to the drill during drilling and allowing excess water together with expended sheer pins to be discharged from the base of the drill pot is also described and claimed.

9 Claims, 1 Drawing Sheet

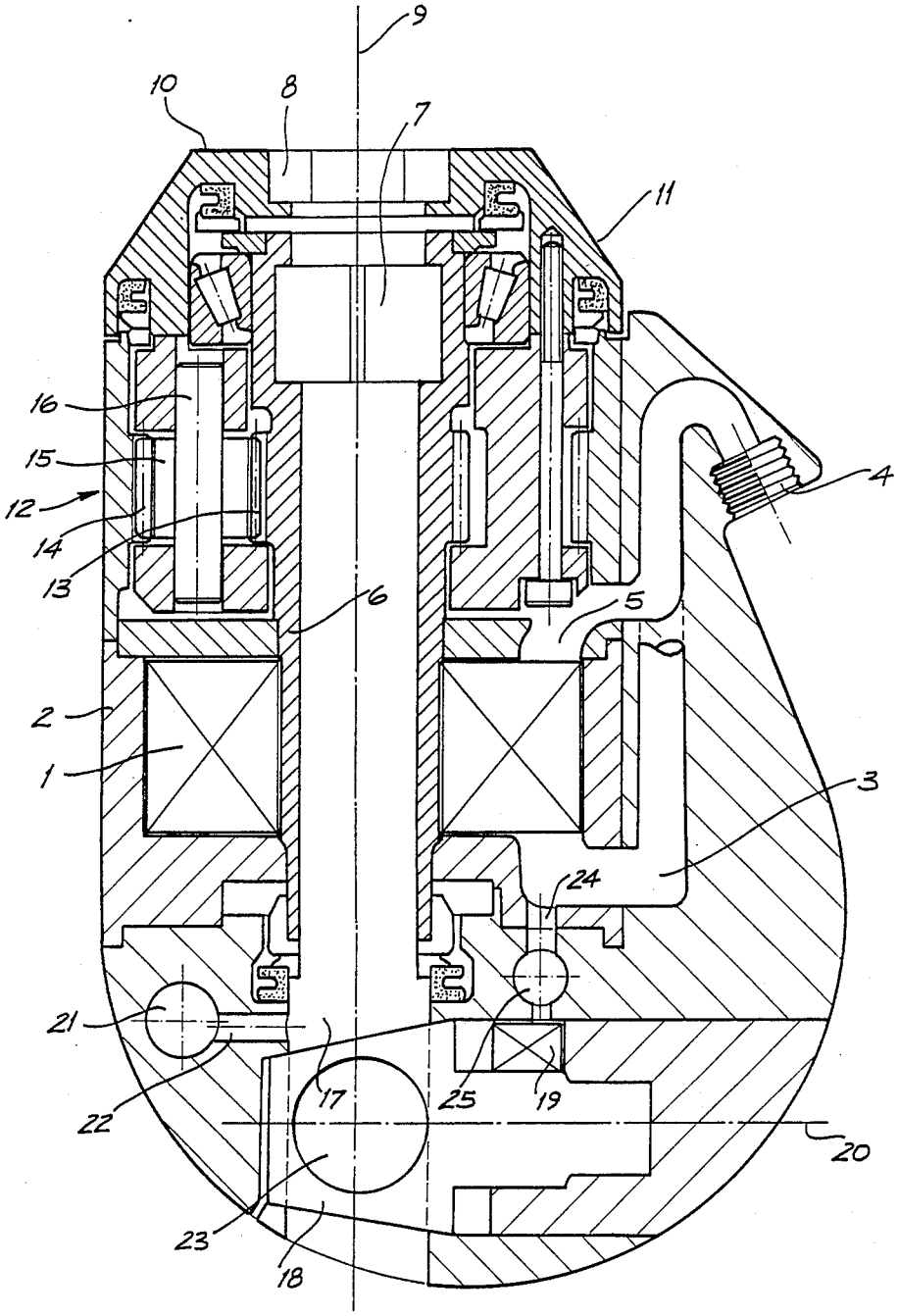
9
10
8
7
11
16
15
12
14
13
6
5
4
2
1
3
24
21
22
17
25
19
20
23
18

ROOF BOLT DRILL POT DRIVE

FIELD OF THE INVENTION

This invention relates to a roof bolt drill pot drive and has been devised particularly though not solely for use in mining operations.

BACKGROUND OF THE INVENTION

In many mining operations, the face is mined by a continuous mining machine having some form of cutting head on the front of the machine which mines the face and removes the minerals for transport to the surface. As the mining machine advances it is necessary to support the roof above the face, and this is commonly achieved by drilling long vertical holes upwardly into the roof and securing roof bolts in place using a quick setting epoxy cement. The holes for the roof bolts are sometimes drilled by a separate drill rig, and the bolts are then secured in place by an alternative power operated bolting socket.

In order to simplify the roof drilling and bolting operation it has become common place to mount the drill rig on the mining machine and to combine the drill rig and the power bolting socket in a single unit. This enables the roof bolts to be drilled and bolted from the mining machine as the machine advances into the face. Existing roof bolt drills of this type are however bulky and cumbersome to operate, frequently requiring the interchange of parts and/or the incorporation of a separate roof bolt drive socket after the drilling operation has been completed. The changeover between drilling mode and roof bolting mode takes time which of course slows the advance of the mining machine and restricts the rate of mining of the mineral face.

The bulky nature of the drilling and bolting mechanisms also limits the number of such drills that can be located side by side across the width of a mining machine and therefore restricts the pitch of the roof bolts which may be inserted using these conventional drills. Mining would be much safer if the bulk of the drilling and bolting machines could be reduced, allowing the machines to be located closer to the mining face, and furthermore allowing a greater number of machines to be placed side by side across the width of the continuous miner.

One of the reasons for the bulk of the machines is that the drilling operation requires a high speed drive with a relatively low torque requirement, whereas the bolting operation is not critical on speed but requires a high torque to securely fasten the nut on the roof bolt. To meet both of these requirements it has been necessary to provide a high speed, high torque drive motor which is large and bulky and which adds to the size of the roof bolt drilling machine.

SUMMARY OF THE INVENTION

The present invention therefore provides a roof bolt drill pot drive comprising a drive motor having a drive shaft, a drill chuck coupled to and driven by the drive shaft, and a bolt socket driven by the drive shaft via a reduction gear box, the drill chuck being coaxially mounted with the bolt socket and both the drill chuck and bolt socket being permanently coupled to and simultaneously driven by the drive motor.

Preferably the drive motor comprises an hydraulic or pneumatic motor, of the vane or gear type.

Preferably the drill chuck is mounted on and coaxial with the drive shaft.

Preferably the reduction gear box comprises a planetary gear box having sun and ring gears coaxial with the drill chuck and bolt socket.

BRIEF DESCRIPTION OF THE DRAWINGS

Notwithstanding any other forms that may fall within its scope, one preferred form of the invention will now be described by way of example only with reference to the accompanying drawing which is a vertical cross section through a roof bolt drill pot according to the invention.

DESCRIPTION OF THE PREFERRED EMBODIMENT

In the preferred form of the invention a roof bolt drill pot is provided driven by an hydraulic motor having vanes (1) contained within a housing (2) and supplied with working fluid, which is typically oil, under pressure through inlet pipe (3) from hose connections (4). Oil passing through the motor returns via outlet (5) to return hoses.

The hydraulic motor drives a hollow drive shaft (6) which extends upwardly through the housing and is directly coupled to a drill chuck (7). The drill chuck, which is typically a square section socket, is arranged to engage the lower end of the drill used for drilling roof bolt holes. The chuck (7) is mounted on and directly coupled to the drive shaft (6) so that it rotates at the same speed as the hydraulic motor (1).

The drill pot is also provided with a bolt socket (8) which is located coaxially with the drive chuck (7) about the centreline (9) and which is adapted to engage with and tighten the bolt head or nut of the roof bolt. The bolt socket has an outwardly extending flange (10) which extends downwardly in a skirt (11) which engages with and is driven by a planetary gear train (12). The planetary gear train comprises a sun gear (13) directly coupled to and driven by the drive shaft (6), a reaction ring gear (14) coupled to and held stationary by the housing (2) and a series of planetary gears (15) each located on shaft (16) and engaged between the ring gear and the sun gear. The shafts (16) are journaled in bearings supported by and engaged with a spider (16A), in turn fastened to and rotatable with skirt (11) so that rotation of the sun gear (13) by the drive shaft (6), operates the planetary gear train and causes the bolting socket (8) to rotate at a much reduced speed driven by the output from the spider (16A).

In this manner operation of the hydraulic motor (1) causes the drill chuck (7) to rotate at high speed and the bolt socket (8) to rotate at a much lower speed with considerable torque multiplication due to the reduction gearing of the planetary gear train (12).

In use a drill bit is firstly engaged in the drill chuck (7), and the drill pot axially advanced upwardly to drill a hole for the roof bolt of the mine. The drill is then withdrawn and removed from the drill pot. The roof bolt is then placed in the hole and the nut of the bolt engaged with the socket (8) whereupon the hydraulic motor (1) is actuated again to tighten the nut on the bolt. Both the drill chuck (7) and the bolting socket (8) are driven simultaneously by the hydraulic motor (1), but the operation of one does not interfere with that of the other as the drill simply passes through the opening of the socket during drilling operations, and the socket (8)

is above the drill chuck (7) for use in the bolting operation.

Because the torque from the hydraulic motor (1) is considerably amplified by the planetary gear box (12), it is possible to provide a high speed, low torque hydraulic drive motor which is extremely compact and therefore enables the size of the drill pot to be reduced. Similarly the coaxial arrangement of the hydraulic drive motor, the planetary reduction gears, the drill chuck, and the bolt socket enables an extremely small drill pot to be achieved. Drill pots of this nature can be placed closely side by side on a mining machine and furthermore are very convenient and fast to operate.

As a further optional feature, the lower end (17) of the hollow drive shaft may be closed off by a rotatable spigot (18) driven by radial vanes (19) about an axis (20). Water is supplied to the drill during the drilling operation through a gallery (21) and thence by a passageway (22) into the lower end (17) of the hollow drive shaft. During the drilling operation the spigot (18) is rotated into the closed position as shown in the accompanying drawings.

Rotation of the spigot to the open position wherein the aperture (23) is aligned with the drive shaft (17) is achieved by the application of hydraulic pressure from the supply channel (3), bled off through aperture (24) and controlled by spool valve (25). The spool valve (25) is actuated by the water pressure supplied to the gallery (21) so as to cause the valve (25) to open or close as water pressure is supplied or removed from the gallery (21). In this manner, the supply of water under pressure through the gallery (21) actuates the spool valve (25) to rotate the spigot (18) to the closed position during the drilling operation, but the removal of water pressure causes the spool valve (25) to open in the opposite direction causing the oil from supply channel (3) to rotate the spigot to the open position allowing water to drain from the bore hole after the drillinq operation has ceased. Because the aperture (23) in the spigot (18) is substantially the same size as the hollow drive shaft (17), opening of the spigot (18) also allows the plastic sheer pins from the bolting operation to drop out through the lower part of the drill pot when the valve (18) is opened.

What I claim is:

1. A roof bolt drill pot drive comprising a drive motor having a drive shaft, a drill chuck coupled to and driven by the drive shaft, and a bolt socket driven by the drive shaft via a reduction gear box, the drill chuck being coaxially mounted with the bolt socket and both the drill chuck and bolt socket being permanently coupled to and simultaneously driven by the drive motor.

2. A roof bolt drill pot drive as claimed in claim 1, wherein the drill chuck is mounted on and coaxial with the drive shaft.

3. A roof bolt drill pot drive as claimed in claim 1, wherein the reduction gear box comprises a planetary gear box having sun and ring gears coaxial with the drill chuck and bolt socket.

4. A roof bolt drill pot drive as claimed in claim 3, wherein the ring gear comprises a reaction gear mounted on a casing of the drill pot, the sun gear is mounted on the drive shaft, and the planetary gear box further includes planet gears each rotatably mounted on a spider driving the bolt socket.

5. A roof bolt drill pot drive as claimed in claim 1, wherein the drive motor comprises an hydraulic or pneumatic motor, of the vane or gear type.

6. A roof bolt drill pot drive as claimed in claim 1, wherein the drive shaft is hollow and rotates in a housing incorporating a water supply conduit communicating with the open lower end of the drive shaft allowing water to be supplied to the drill chuck and hence the drill bit through the hollow drive shaft from the water supply conduit during drilling.

7. A roof bolt drill pot drive as claimed in claim 6, wherein the housing is provided with a passageway forming a continuation of the lower end of the hollow passage in the drive shaft, the passageway being closed at its lower end below a connection to the water supply conduit, by a valve having an opening therethrough, in the open position, of substantially the same section as the hollow passage through the drive shaft.

8. A roof bolt drill pot drive as claimed in claim 7, wherein the valve incorporates a spigot rotatable about an axis perpendicular to the axis of the passageway, said opening passing through the spigot and having an axis perpendicular to the axis of the spigot such that rotation of the spigot causes the opening to move into and out of register with the passageway.

9. A roof bolt drill pot drive as claimed in claim 8, wherein the spigot is rotatable by hydraulic pressure supplied to the drive motor under the control of a spool valve actuable by the supply of cooling water to the drill and arranged such that the spigot is rotated to close the lower end of the passageway when cooling water is supplied under pressure, and to open the lower end of the passageway at other times.

* * * * *